United States Patent [19]

Martin

[11] Patent Number: 4,538,539

[45] Date of Patent: Sep. 3, 1985

[54] DEFORMABLE SHROUDED WATER FOIL

[76] Inventor: David E. Martin, 27786 Rainbow Cir., Lathrup Village, Mich. 48076

[21] Appl. No.: 591,504

[22] Filed: Mar. 20, 1984

[51] Int. Cl.[3] ..... B63B 3/38

[52] U.S. Cl. ..... 114/140; 114/144 R; 114/287

[58] Field of Search ..... 114/39, 127, 128–139, 114/274–282, 162–164, 140; 244/219 A

[56] References Cited

U.S. PATENT DOCUMENTS

| | | | |
|---|---|---|---|
| 1,790,309 | 1/1931 | Kientz | 244/219 A |
| 1,924,871 | 8/1933 | Lundington | 114/141 |
| 2,912,190 | 11/1959 | MacDonough | 244/219 A |
| 3,505,968 | 4/1970 | Gorman | 114/126 |
| 3,753,415 | 8/1973 | Burtis | 114/127 |
| 4,064,821 | 12/1977 | Roberts | 114/103 |
| 4,074,646 | 2/1978 | Dorfman et al. | 114/162 |
| 4,280,433 | 7/1981 | Haddock | 114/127 |
| 4,341,176 | 7/1982 | Orrison | 114/102 |

FOREIGN PATENT DOCUMENTS

| | | | |
|---|---|---|---|
| 50343 | 4/1941 | Netherlands | 114/103 |
| 51251 | 9/1941 | Netherlands | 114/103 |

*Primary Examiner*—Jesus D. Sotelo

*Attorney, Agent, or Firm*—Banner, Birch, McKie & Beckett

[57] ABSTRACT

An underwater appendage for sailboats, such as a keel or rudder, is fitted with an external shell-like shroud, which is placed around a core portion of the appendage such that the outer shroud forms a deformable water foil which is fastened on both sides of the core near its rear or trailing edge, and which shroud is everywhere else spaced away from the core. This deformable shroud forms a hydrofoil, the leading edge of which can be displaced to either side of the core by means of inflatable bladders placed on either side of the core, thus creating a desired angle of attack for the deformable foil, either to port or starboard. Inflation of the bladder on the windward side of the boat creates an angle of attack to windward and also a bulging of the shrouded water foil on the windward side creating the desired hydrodynamic lift to counter the lateral component of the aerodynamic force on the sail. As the boat is turned through the wind, onto the opposite tack, the pressure on the bladder is relaxed as it becomes the leeward bladder, and pressure on the opposite bladder is increased as it becomes the windward bladder. Pressure on both bladders can be relaxed when no lift is desired as when running before the wind.

6 Claims, 10 Drawing Figures

DEFORMABLE SHROUDED WATER FOIL

FIELD OF INVENTION

The present invention relates to improvements in underwater appendages for boats, such as a keel or rudder, which appendages are intended to develop hydrodynamic lift in a direction perpendicular to the motion of the appendage through the water.

DESCRIPTION OF PRIOR ART

It has been well-recognized that the hydrodynamic lift that a keel must provide to allow a sailboat to sail (tack) to windward can be enhanced if the keel foil shape is asymmetric as with an airplane wing. C. A. Marchaj, in "Sailing Theory and Practice" (Dodd and Mead, NY 1964) explains the theory and advantages of using two different centerboards, each of which is asymmetric and has its own angle of attack (see Marchaj, FIG. 171, page 283). One is raised while the other is down in the water such that it provides lift to counteract the sideward component of aerodynamic force on the sail. The angle of attack of the down board is such that it is possible to reduce the yaw angle of the boat and, thus, reduce the resistance of the boat moving through the water. This method of deriving the desired asymmetry and angle of attack is satisfactory for centerboards that can be quickly raised or lowered. But it is not practical for boats employing heavy ballast keels, as the heavy ballast would be difficult to raise and it would (when raised) raise the center of gravity of the boat, decreasing the static roll stability of the boat.

U.S. Pat. No. 4,280,433, of Haddock, illustrates an articulated keel assembly which will automatically adjust its shape and angle of attack to provide the desired lift to port or starboard as the course of the vessel is changed, and the direction of the aerodynamic side force, relative to the boat, is changed. Haddock notes that, "My present invention has been devised to provide a keel which will be of robust construction so that it can take grounding without fear of additional damage, and will support the vessel when slipped and, furthermore, the keel according to my present invention has been devised so that it can be quickly stripped on the slipway for defouling and will enable the necessary internal ballast to be carried within the keel, even when the latter has an aspect ratio of 1 to 1.25 or greater for best lift to drag ratios."

The invention of Haddock does appear to offer advantages over those of Burtis (U.S. Pat. No. 3,753,415) and Dorfman (U.S. Pat. No. 4,074,646) which did not provide a means of changing the angle of attack of the keel. However, the invention of Haddock requires a complex, articulated assembly of 55 identified parts. Haddock's invention is so complex that it cannot be readily adapted to existing keels, requiring that existing boats be subjected to major alterations, including the total removal of existing keels, in order to employ the device. Moreover, its complexity, particularly the shafts and linkages which pass through two glands on the bottom of the boat, would make adaptation in the form of a liftable ballast keel more difficult.

SUMMARY OF THE INVENTION

My present invention has been devised in order to provide a simple inexpensive means of modifying existing fixed, robust, ballast keels so that their foil shape and angle of attack can be quickly adjusted. Such adjustments in shape and angle of attack, relative to the centerline of the boat, will provide hydrodynamic lift to port or starboard with less yaw angle of the boat. The reduced yaw angle, meaning the boat moves through water at an angle closer to the centerline of the boat, reduces the hydrodynamic resistance, and or allows the boat to sail closer to the wind. Such adjustments from port to starboard can be made continuously for various courses relative to the wind. For a course directly before the wind, the foil shape will be symmetrical and the angle of attack will be zero.

An additional objective is to provide a simple, inexpensive means of accomplishing the same adjustments on totally-new, fixed keel designs and on liftable ballast keels that can be retracted into the hull for the purposes of reduced draft and or hydrodynamic resistance.

This invention accomplishes the afore objectives, and others, by means of hydraulic pressure which displaces and bulges a deformable shroud which is placed around the keel, forming a hydraulic foil shape, and which shroud is fixed to the keel only at its back edge. The hydraulic pressure which bulges one side of the deformable shroud also displaces the leading edge of the shroud in the direction of the bulge, thus simultaneously providing both the desired asymmetry of the foil for lift and the desired angle of attack. The hydraulic pressure can be applied by means of rubber-like bladders placed suitably on both sides of the rigid ballast keel and between the keel and shroud. Alternatively, if desired or more suitable for a particular installation, the deformation and displacement can be accomplished by means of laterally-oriented hydraulic cylinders, such as employed by Dorfman in U.S. Pat. No. 4,074,646, in which invention the asymmetrical shape can be accomplished but not a change in angle of attack since the flexible "skin" in Dorfman's invention is not free to displace relative to the keel "core" at its leading edge as it is in the present invention.

Pressure to the actuating bladders or cylinders can be provided by means of either hand pumps or motor-driven pumps. Adjustments to the foil shape and angle of attack can be made by adjusting the hydraulic pressure to one or both sides of the keel to a level that has been found by experience to be best for speed and or course. Alternatively, the pressure or pressures can be adjusted to accomplish a minimum or desired yaw angle as measured by a simple vane meter mounted in the water in front of the boat in a manner similar to that illustrated in FIG. 194, page 312 of "Sailing Theory and Practice" by C. A. Marchaj (Dodd and Mead, NY 1964).

DESCRIPTION OF INVENTION

Figure 1:
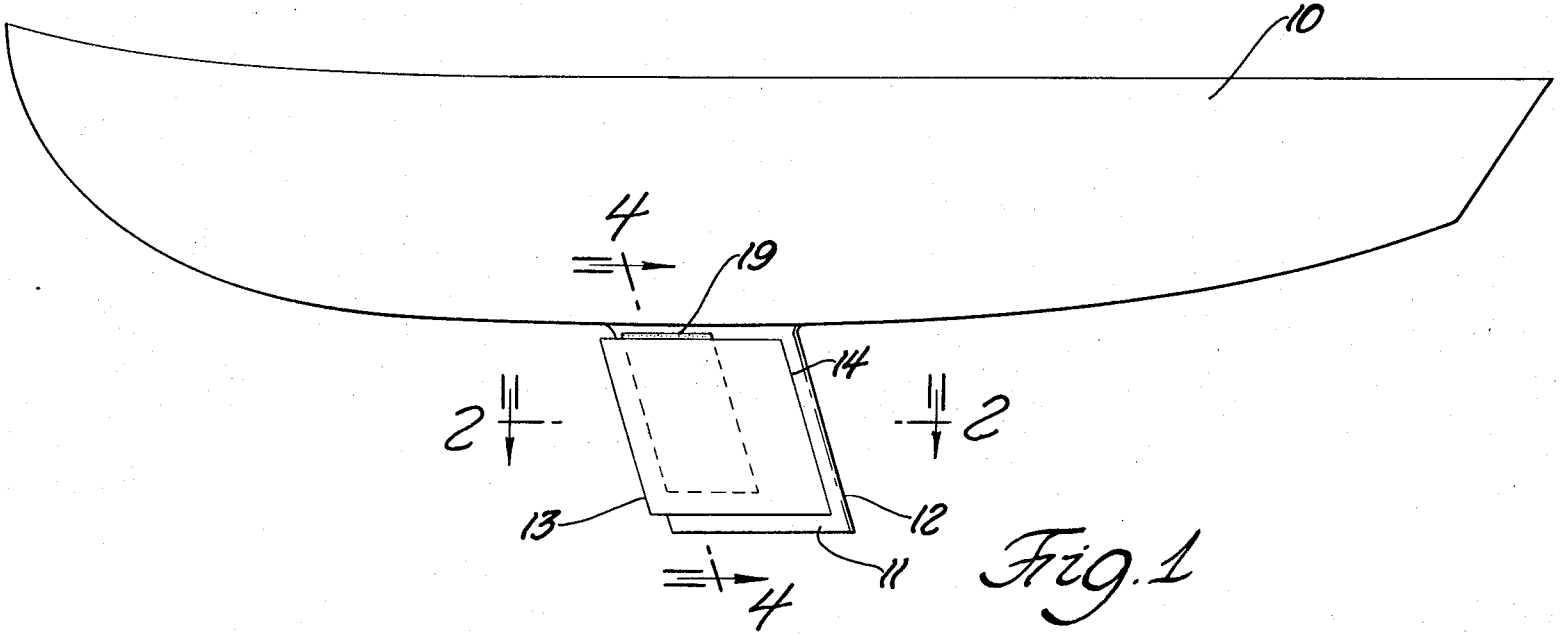
FIG. 1 is a side elevation of a sailboat hull showing a fixed-ballast keel to which the displaceable and deformable hydrodynamic foil shroud has been attached near the rear or trailing end of the keel.
Figure 2:
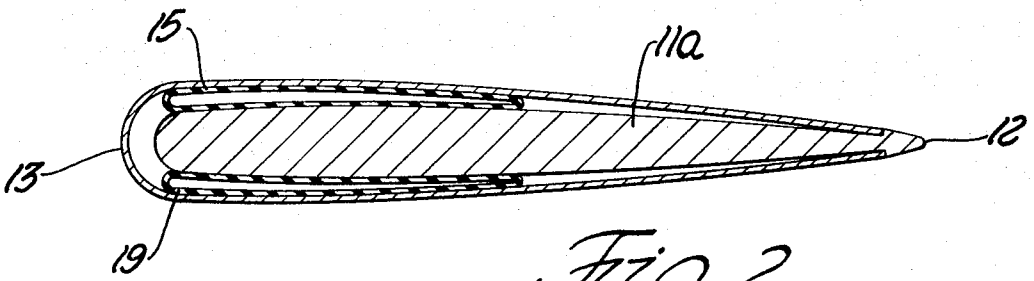
FIG. 2 is a horizontal section of the keel-shroud assembly along line 2—2 of FIG. 1, showing the shroud in a symmetrical shape and with the bladders on both sides of the keel deflated.

Referring to FIGS. 1 and 2, a conventional sailboat hull 10 is equipped with a fixed ballast keel 11, having a foil section, 11*a*, evident in FIG. 2. As shown in FIG. 1, deformable shroud 13, is placed around the fixed keel and is fastened to the fixed keel on each side along a line 14 at or near the rear edge of the keel 12. On each side of the keel, a bladder 19, as shown in FIG. 1, and 19 and 15, as shown in FIG. 2, is placed between the keel 11 and the deformable shroud 13. In FIG. 2 the bladders are deflated and the shroud is shown in its symmetrical form.

Figure 3:
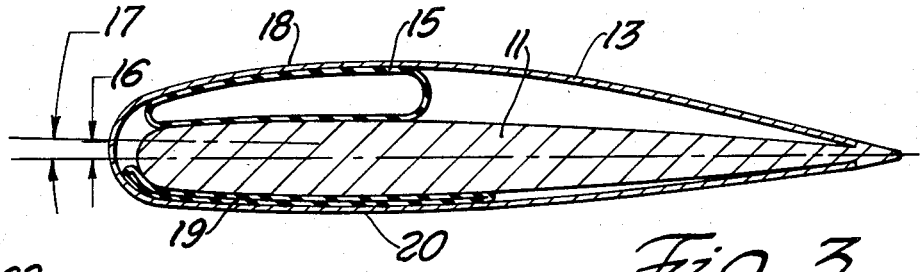
FIG. 3 is a horizontal section of the keel-shroud assembly alone line 2—2 of FIG. 1 showing the front of the shroud displaced to one side and the shroud deformed outward by an inflated bladder.

As shown in FIG. 3, the hydrofoil created by the shroud 13 can be displaced and bulged by inflation of the bladder 15 by hydraulic fluid. The front end of the shroud is free to displace 16, while the rear edges are fixed, creating an angle of attack 17, simultaneously with a bulge at 18 which is desired to gain lift. The opposite side bladder 19 is shown in a deflated state which yields a relatively flat side 20 opposite the bulge.

Figure 4:
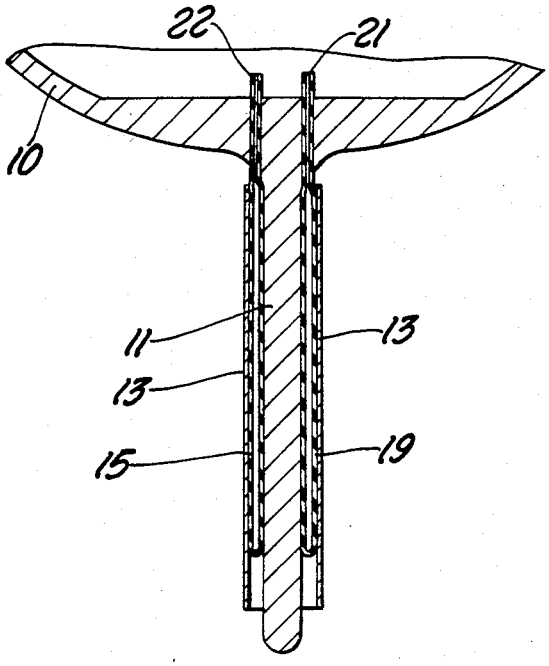
FIG. 4 is a vertical cross section along line 4—4 of FIG. 1 showing the shroud in symmetric adjustment, hydraulic actuating bladders and through-hull hydraulic tubes for actuating pressure.

Referring to FIG. 4, the shroud 13 is shown in symmetrical form with the bladders 15 and 19 deflated and the through-hull tubes 21 and 22 for bladder inflation and deflation are also shown.

Figure 6:
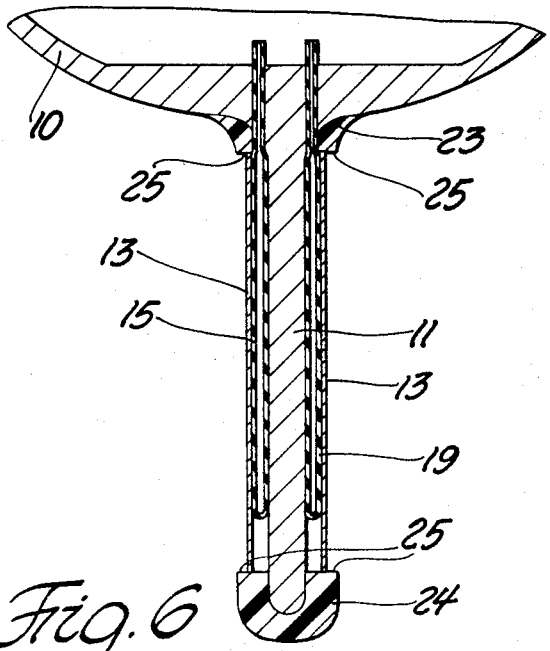
FIG. 6 is a vertical cross section taken along line 6—6 of FIG. 5 showing the fairings at the hull and keel bottom.
Figure 5:
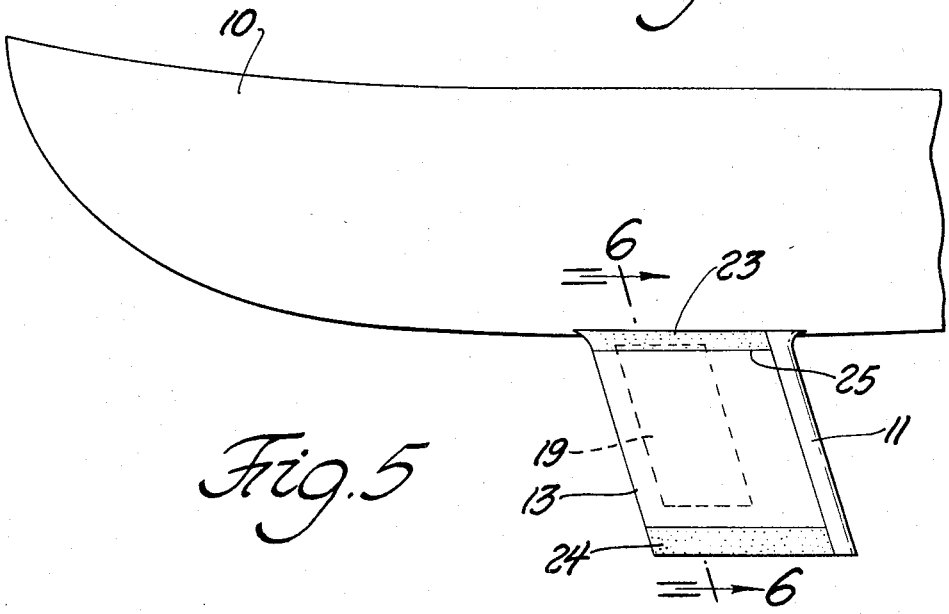
FIG. 5 is a fragmentary side elevation of the sailboat showing the keel-shroud assembly with the fairings added at the hull and keel bottom.

FIG. 5 shows the side elevation with fairings added at the hull 23 and at the bottom of the keel 24 which were not depicted in earlier drawings for the sake of clarity. Note in FIG. 6 that the fairings extend laterally beyond the outside surface of the shroud 25 in its symmetrical position in order to close any gap that would otherwise exist when the shroud were displaced and deformed. The dimension of these extensions will be determined by a line which defines the maximum displacement of the shroud in its most deformed state. This will, of course, be different with each boat design, as will be many other specifics of such a modification.

Figure 7:
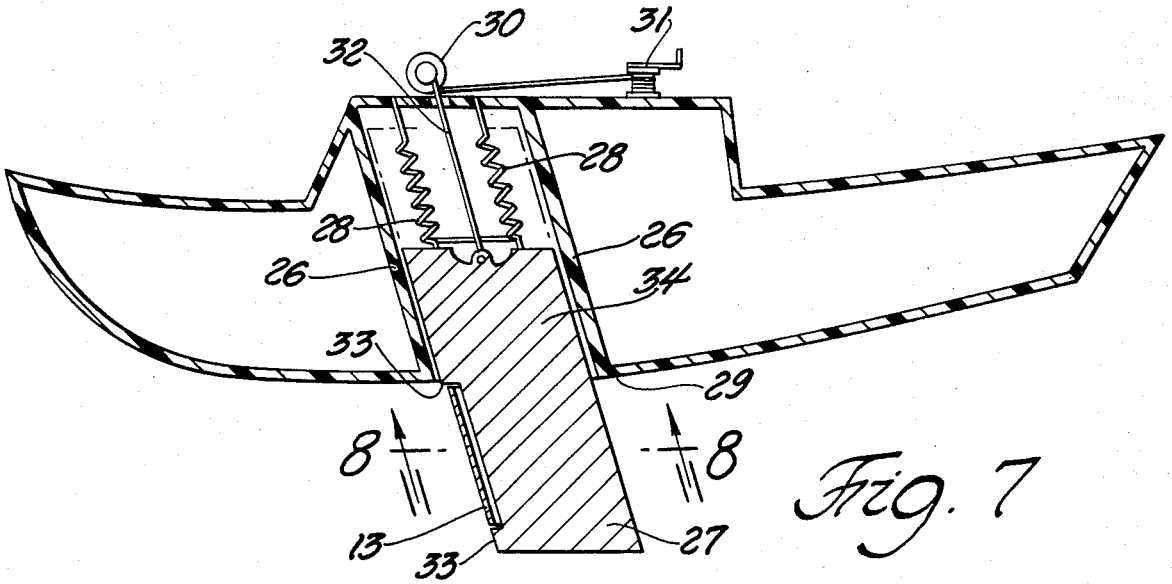
FIG. 7 is a longitudinal cross section of a boat having a retractable keel which has a displaceable-deformable shroud and the flexible hydraulic lines for actuation of bladders.
Figure 8:
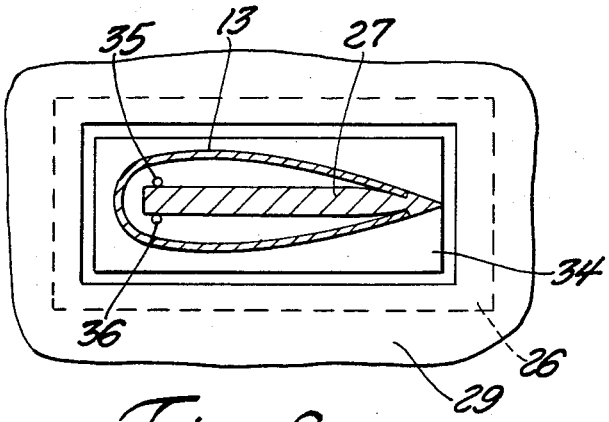
FIG. 8 is a horizontal cross section along line 8—8 of FIG. 7 showing the construction of the retractable keel, the deformable shroud, the through-ports for passage of the actuating hydraulic fluid, and the rectangular housing in the bottom of the boat.

Referring to FIG. 7, a sailboat hull is shown in longitudinal vertical section revealing a housing 26 designed specifically for a retractable keel 27. In this embodiment of the invention the keel-shroud assembly is designed anew and is not simply a modification of an existing ballast keel. Shown, conceptually, are flexible hoses 28 for communication of hydraulic pressure to bladders, or as the case may be, hydraulic cylinders, to displace and deform the shroud 13 affixed at or near the rear edge of the lower portion of the retractable keel which can be extended below the bottom of the boat 29. FIG. 7 also depicts a concept drum 30 in concert with a winch 31 for raising and lowering the keel 27 by means of a cable 32, but alternative mechanisms can be employed. The purpose of FIG. 7 is to illustrate that the simple hydraulically actuated deformable-displaceable shroud can be readily adapted to retractable keels through flexible hydraulic tubes or hoses. Clearly this would also be the case with ballast keels that were retracted by rotation on a pivot such as with many centerboard designs. FIG. 7 also shows that in the instance where the displaceable, deformable shroud is designed initially in concert with the keel to which it is attached, no fairings need be added since the basic keel shape will be designed with the addition of the shroud contemplated. This is evident in FIG. 7 by virtue of the integral extension 33 of the keel over the front of the shroud 13 at both top and bottom. This integral extension can clearly exist all around the perimeter of the shroud at its bottom, and even more evidently at its top as indicated in FIG. 8. FIG. 8 shows the shroud 13 placed around the retractable keel 27. Note that since the ballast keel is not designed to be used as a foil, as in the case of existing boats depicted in FIG. 1, it can be shaped (here rectangular) to best accommodate the desired displacements of the shroud 13. FIG. 8 also shows the upper portion of the keel 34, which, in this case, is rectangular in form, fitting with slight clearance into the rectangular housing 26 in the bottom of the boat 29. The form of the housing, however, can vary and is only here identified as being rectangular for the sake of clarity. Also shown in FIG. 8, are hydraulic passages 35 and 36 for communication of hydraulic fluid down through the upper portion of the keel from the flexible hoses 28, as shown in FIG. 7, to the bladders that will fit on either side of the keel, but which are not shown in this embodiment.

Figure 9:
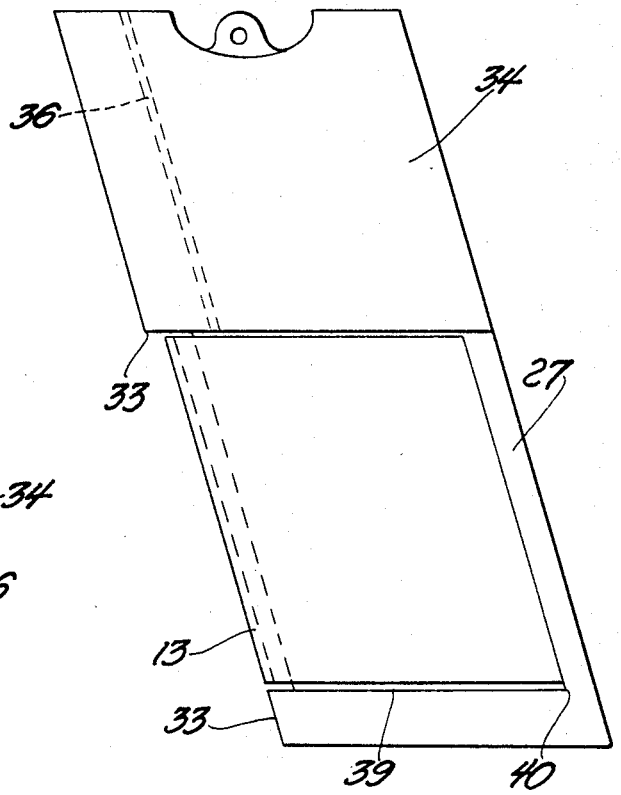
FIG. 9 is a side elevation of the retractable keel that is shown in section view in FIG. 7.

Referring to FIG. 9, the upper rectangular portion 34 of the rectractable keel is shown. This upper portion fits into the housing 26, shown in FIGS. 7 and 8. Also shown in FIG. 9, is the lower portion of the retractable keel 27, about which the deformable shroud 13 is placed as shown also in FIGS. 7 and 8. Also shown in FIG. 9, is one of the hydraulic passages 36, which can communicate pressure from the flexible hoses shown in FIG. 7, down to the bladders (not shown) which deform and displace the hydrofoil shroud 13. FIG. 9 also shows the keel extension 33 which closes the gap that would exist at the bottom of the shroud were said extension not provided. Line 39 in FIG. 9 defines the extension along the side of the keel which terminates at 40 where the shroud is fixed.

Figure 10:
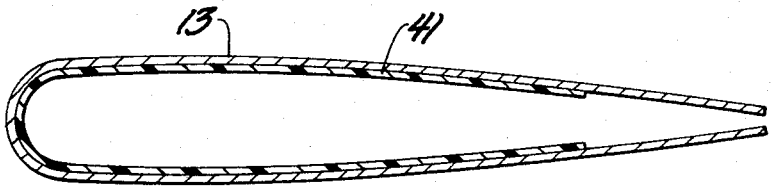
FIG. 10 is a horizontal cross section of a deformable shroud to which a damping material has been bonded on the interior surface.

FIG. 10 shows a cross section of a deformable shroud 13 but with damping material 41 bonded to its interior surface. Such an added feature may be helpful in order to damp oscillatory motions of the deformable shroud. The shroud 13 can be made of sheetmetal or a plastic material, such as fiberglass. Addition of such damping material can be made as necessary in order to damp out any oscillatory motions as may occur in a specific design application of the concept.

OPERATION

The operation of this invention is exceedingly simple since it only requires that hydraulic pressure be applied to first one and then the other side of the shroud 13 which forms the desired hydrofoil shape. When the boat is on the starboard tack, having the wind coming from the starboard side, the sail pressure will not just drive the boat forward, it will push it sideways to port. Thus, in this instance, it is desired that the starboard side of the keel be bulged in order that the water passage over the bulge reduce the pressure, giving lift toward the starboard, counteracting the wind pressure which would otherwise drive the boat to port. Thus, hydraulic pressure is admitted to the side of the keel from which the wind is coming, creating the desired angle of attack to windward and a bulge to windward.

The magnitude of the hydraulic pressure that must be applied for the deformation and displacement of the shroud will be slight because once said deformation is initiated, the reduced water pressure on the outside of the bulged side and relatively higher water pressure on the flatter opposite side of the shroud will work to maintain the desired shape. The hydraulic pressure in one or both (port and starboard) bladders will be adjusted to control the shape of the shroud. If desired, the pressure in one bladder could be reduced to a level below atmospheric pressure in order to gain more "flattening" action on the side opposite the windward or bulged side. Such reduced pressure could be gained by any simple evacuating pump. Pressure measurements for control and adjustment can be made with standard Bourdon gauges or simple manometers made of transparent tubings, in which case the height of the water in the tubes will indicate the pressure.

While the invention has been described in relation with specific embodiments, it will be evident to those knowledgeable in the art of boat design that various modifications and applications of the basic concept may be made to various underwater appendages, such as keels and rudders, within the scope of the following claims.

I claim:

1. An underwater appendage for a sailboat of the type having a hull and at least one underwater appendage, said appendage comprising: a core portion being substantially keel-shaped having mounting means to said hull, a shell-like foil-shaped flexible outer shroud placed around the said core which shroud has a rounded front portion descending parallel to the front edge of the core appendage, with free space between the core and the rounded front of the shroud, and with the two sides of said shroud enveloping the opposite sides of said core, with the upper and lower edges of said shroud being essentially horizontal and with the upper edge being close to the bottom of said hull, and the lower edge being nearer to the bottom of said core, with said shroud being disposed such that the sides of the shroud are essentially parallel to the core, and spaced outward from it, such that the distances of the outer shroud sides from said core is substantially constant along a line parallel to the descending axis of said core but which distance gradually diminishes toward the rear descending edge of said core such that the opposite sides of the shroud join their respective sides of the core near the rear descending edge of the said core with there being mounting means for both rear edges of said foil shroud to the said core where said shroud joins said core, forming an outer foil shaped shroud in a position such that the incidence of said foil is substantially parallel to the fore/aft axis of the boat in the undeformed symmetrical condition of said shroud and cross sections of said foil in any horizontal plane having a rounded front incidence portion tapering toward the rear edge such that a hydrofoil shape is formed by said shroud and a space exists between said shroud and the core at all points on the inside surface of said shroud except where it has mounting means along its rear edge where it joins the said core, said mounting means being the only attachment of said shroud such that said spaces provide space for displacing the forward round descending portion of the shroud to either side of said core, and space for the corresponding side of the shroud to displace in the same direction, except for the rear fixed edge of such side, and space for the opposite side of said shroud to displace inward toward said core, creating an incidence angle between the axis of said foil shroud and the fore-/aft axis of said boat, and said space receiving variable actuating means for said displacing and for bulging of said shroud on the side which has been displaced outward, and variable actuating means for said bulging and said displacing of said shroud and variable actuating means for flattening the opposite side of said shroud such that an asymmetrical foil shape may be formed, creating lift in the direction in which the foil is both displaced and bulged and reversing means for such actuation in the opposite direction such that the desired hydrodynamic lift may be created on the opposite side of the appendage, said variable means also adjusting the shroud to a symmetrical foil when no lift is desired.

2. An underwater appendage, according to claim 1, wherein the said core is thicker above and below the said upper and lower horizontal edges of said shroud, such that the thicker portion of said core above the shroud extends down to a plane parallel to the said upper horizontal edge of said shroud, said lower horizontal plane of the said thicker portion of said core being only slightly above the upper horizontal edge of said shroud such that sufficient clearance exists for inward and outward displacement of the free upper edge of said shroud but which said clearance will be minimum, and the thickness of said portion of the core will be everywhere defined to form a symmetrical hydrofoil shape, the outer edge of which will be defined by the maximum displacement and bulging of the shroud, said shape of said core tapering toward the back edge where it will be coincident with the back edge of said shroud where said shroud joins said core below said horizontal clearance line, thereby minimizing disturbance of the flow of water along this horizontal line on the appendage, the thicker portion of the said core below the said lower horizontal edge of the said shroud will also be so shaped with minimum clearance for the same purpose.

3. An underwater appendage according to claim 1 wherein said variable actuating means comprises two inflatable bladders between said core and the sides of said shroud near the front of said core, one of said bladders on the port side of said core and the second of said bladders on the opposite side of said core, said bladders each being made of stretchable rubberlike sheet material and each said bladder being comprised of two major sheets, each being substantially rectangular or parallelogram in shape and of the same size, with the two said sheets being closely spaced and joined together along their respective perimeters such that a closed flat bladder is formed, of such size and shape to be placed in the afore said space between said core and said shroud on one side of said core and with the second said bladder being disposed on the opposite side of said core, with means provided for communicating pressure to each of said bladders, said pressures being independently controlled to each bladder such that one or the other said bladder may be inflated such that the said shroud can be displaced and bulged by said pressure, to first one and then the other side of said boat in order to gain lift in the desired direction, or pressure to both said bladders reduced such that said shroud assumes a symmetrical foil shape when no side force is desired on said appendage.

4. An underwater appendage as recited in claim 3 further comprising a plurality of independently controlled additional bladders between said core and said shroud for providing precise control of the shape of the shroud.

5. An underwater appendage according to claim 1 with a layer of high damping material bonded to the surface of said flexible shroud in order to dampen out any undesirable oscillations of said shroud.

6. A sailboat of the type having a hull and at least one underwater appendage, said appendage comprising: a core portion being substantially keel-shaped having mounting means to said hull; a shell-like foil-shaped flexible outer shroud placed around the said core, which shroud has a rounded front portion descending parallel to the front edge of the core appendage, with free space between the core and the rounded front of the shroud, and with the two sides of said shroud enveloping the opposite sides of said core, with the upper and lower edges of said shroud being essentially horizontal, and with the upper edge being close to the bottom of said hull, and the lower edge being nearer to the bottom of said core, with said shroud being disposed such that the sides of the shroud are essentially parallel to the core, and spaced outward from it, such that the distances of the outer shroud sides from said core is substantially constant along a line parallel to the descending axis of said core but which distance gradually diminishes toward the rear descending edge of said core such that the opposite sides of the shroud join their respective sides of the core, near the rear descending edge of the said core with there being mounting means for both rear edges of said foil shroud to the said core where said shroud joins said core, forming an outer foil shaped shroud in a position such that the incidence of said foil is substantially parallel to the fore/aft axis of the boat in the undeformed symmetrical condition of said shroud and cross sections of said foil in any horizontal plane having a rounded front incidence portion tapering toward the rear edge such that a hydrofoil shape is formed by said shroud and a space exists between said shroud and the core at all points on the inside surface of said shroud except where it has mounting means along its rear edge where it joins the said core, said mounting means being the only attachment of said shroud such that said spaces provide space for displacing the forward round descending portion of the shroud to either side of said core, and space for the corresponding side of the shroud to displace in the same direction, except for the rear fixed edge of such side, and space for the opposite side of said shroud to displace inward toward said core, creating an incidence angle between the axis of said foil shroud and the fore/aft axis of said boat; and said space receiving variable actuating means for said displacing and for bulging of said shroud on the side which has been displaced outward, and variable actuating means for said bulging and said displacing of said shroud and variable actuating means for flattening the opposite side of said shroud such that an asymmetrical foil shape may be formed, creating lift in the direction in which the foil is both displaced and bulged and reversing means for such actuation in the opposite direction such that the desired hydrodynamic lift will be created on the opposite side of the appendage, said variable means also adjusting the shroud to a symmetrical foil when no lift is desired.

* * * * *